US010869114B2

(12) United States Patent
Wilson et al.

(10) Patent No.: US 10,869,114 B2
(45) Date of Patent: Dec. 15, 2020

(54) MOBILE MUSIC STORE ASSEMBLY

(71) Applicants: Ryan Wilson, Los Angeles, CA (US); Carson Lere, Glendale, CA (US)

(72) Inventors: Ryan Wilson, Los Angeles, CA (US); Carson Lere, Glendale, CA (US)

( * ) Notice: Subject to any disclaimer, the term of this patent is extended or adjusted under 35 U.S.C. 154(b) by 0 days.

(21) Appl. No.: 16/292,187

(22) Filed: Mar. 4, 2019

(65) Prior Publication Data

US 2020/0288225 A1 Sep. 10, 2020

(51) Int. Cl.
*H04R 1/02* (2006.01)

(52) U.S. Cl.
CPC ..... *H04R 1/028* (2013.01); *H04R 1/026* (2013.01); *H04R 2201/028* (2013.01); *H04R 2420/09* (2013.01); *H04R 2430/01* (2013.01)

(58) Field of Classification Search
CPC .. H04R 1/028; H04R 1/026; H04R 2201/028; H04R 2420/09; H04R 2430/01
See application file for complete search history.

(56) References Cited

U.S. PATENT DOCUMENTS 4,884,646 A * 12/1989 Zambias ..... B60R 11/02 180/90
6,006,915 A * 12/1999 Moor ..... A45C 3/00 190/102
8,113,346 B1 * 2/2012 Lai ..... H04R 1/025 206/320
8,475,215 B2 * 7/2013 Kan ..... H01R 13/501 439/638
2002/0096975 A1 * 7/2002 Yu ..... G11B 33/0483 312/9.52
2004/0258265 A1 * 12/2004 Cordova ..... H04R 5/023 381/334
2006/0039263 A1 * 2/2006 Trotabas ..... B60R 11/02 369/86
2015/0176884 A1 * 6/2015 Grepper ..... F25D 23/00 220/592.2

* cited by examiner

*Primary Examiner* — Andrew L Sniezek
(74) *Attorney, Agent, or Firm* — Roeder & Broder LLP; James P. Broder

(57) ABSTRACT

A mobile music store assembly includes a housing base; a first housing member that is selectively movable relative to the housing base between a first position wherein the mobile music store assembly is in a closed configuration, and a second position wherein the mobile music store assembly is in an open configuration; and a second housing member that is selectively movable relative to the first housing member and the housing base between a first position wherein the mobile music store assembly is in the closed configuration, and a second position wherein the mobile music store assembly is in the open configuration. The mobile music store assembly can further include a music player that is positioned substantially within the housing assembly. The music player is only accessible when the mobile music store assembly is in the open configuration.

20 Claims, 6 Drawing Sheets

MOBILE MUSIC STORE ASSEMBLY

BACKGROUND

The music industry continues to grow in popularity, and, thus, musical artists have increasing competition in promoting their product to the public. Therefore, it is desired to create an innovative and convenient way to promote music to the consumer public, which focuses on customer service and unique experiences.

SUMMARY

The present invention is directed toward a mobile music store assembly. In various embodiments, the mobile music store assembly includes a housing assembly including (i) a housing base; (ii) a first housing member that is selectively movable relative to the housing base between a first position wherein the mobile music store assembly is in a closed configuration, and a second position wherein the mobile music store assembly is in an open configuration; and (iii) a second housing member that is selectively movable relative to the first housing member and the housing base between a first position wherein the mobile music store assembly is in the closed configuration, and a second position wherein the mobile music store assembly is in the open configuration.

In some embodiments, the housing assembly further includes a guide assembly that guides the movement of the first housing member and the second housing member relative to the housing base.

Additionally, in certain embodiments, the mobile music store assembly further includes a music player that is positioned substantially within the housing assembly. In such embodiments, the music player is only accessible to the user when the mobile music store assembly is in the open configuration. In some such embodiments, the mobile music store assembly can further include a mover assembly that is coupled to the music player. In such embodiments, the mover assembly is configured to move the music player between a retracted position and an extended position when the mobile music store assembly is in the open configuration.

In one such embodiment, the mobile music store assembly further includes a speaker that is electrically coupled to the music player, the speaker being positioned substantially within the housing assembly. Additionally and/or alternatively, the mobile music store assembly can further include headphones that are electrically coupled to the music player, the headphones being positioned substantially within the housing assembly.

Further, in some embodiments, the mobile music store assembly further includes a power assembly that provides power to the music player. In such embodiments, the power assembly can include a power source that is fully contained within the housing assembly. Additionally, in certain such embodiments, the power assembly further includes a recharging port and a recharging cable that is selectively electrically coupled to the recharging port to recharge the power source.

Additionally, in certain embodiments, at least one of the first housing member and the second housing member includes a housing body; and the housing assembly further includes a first body panel that is removably coupled to the housing body. Additionally, in some such embodiments, the housing assembly can further include a second body panel that is alternatively, removably coupled to the housing body.

The present invention is further directed toward a mobile music store assembly that is selectively movable by a user between a closed configuration and an open configuration, the mobile music store assembly comprising (i) a housing assembly; (ii) a music player that is positioned substantially within the housing assembly; and (iii) a speaker that is electrically coupled to the music player, the speaker being positioned substantially within the housing assembly; and wherein the music player and the speaker are only accessible to the user when the mobile music store assembly is in the open configuration.

Additionally, in some applications, the present invention is also directed toward a mobile music store assembly that is selectively movable by a user between a closed configuration and an open configuration, the mobile music store assembly comprising (i) a housing assembly; (ii) a music player that is positioned substantially within the housing assembly; and (iii) headphones that are electrically coupled to the music player, the headphones being positioned substantially within the housing assembly; and wherein the music player and the headphones are only accessible to the user when the mobile music store assembly is in the open configuration.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a mobile music store assembly 10 (also sometimes referred to herein as a "music store assembly" or simply an "assembly"). In particular, in various embodiments, the music store assembly 10 is uniquely configured to provide an innovative and convenient way to promote music to the consumer public, which is easily movable from one site to another, and which is movable between multiple configurations for ease of use.

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Additionally, it is further appreciated that not all features of a given embodiment are necessarily illustrated in each of the Figures for purposes of clarity, i.e. so that certain features may be more easily and clearly identified and described within any given Figure.

Figure 1A:
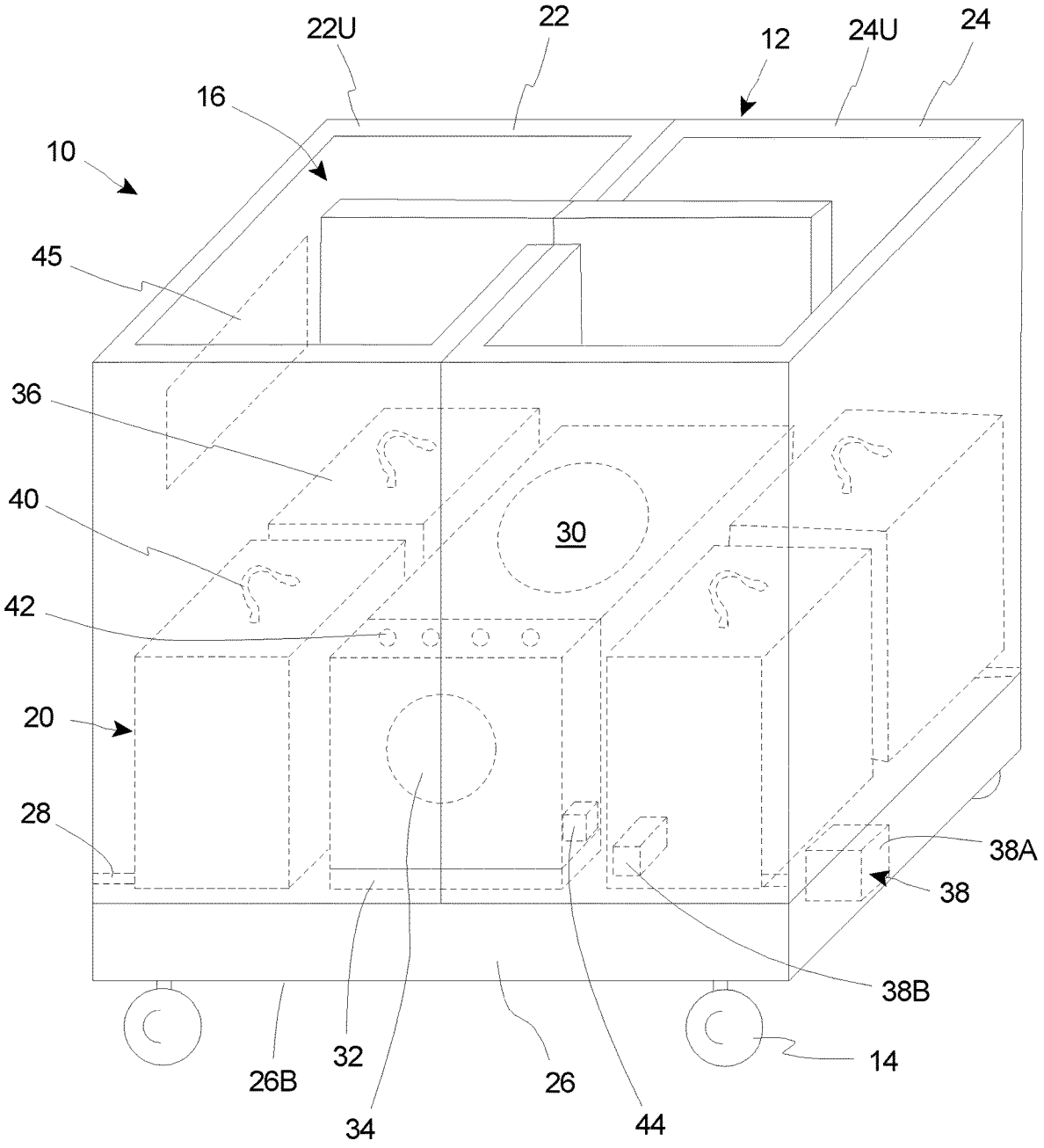
FIG. 1A is a simplified perspective view illustration of an embodiment of a mobile music store assembly having features of the present invention, the mobile music store assembly being in a closed configuration.

FIG. 1A is a perspective view of an embodiment of a mobile music store assembly 10 having features of the present invention. The design of the music store assembly 10 can be varied to suit the specific requirements of the user. For example, although the music store assembly 10 is primarily described herein as utilizing, playing and promoting vinyl records, other formats for providing the music can also be utilized, e.g., cassette tapes, CDs, etc.

As described in detail herein, the mobile music store assembly 10 is a multi-faceted platform for interacting with vinyl records that functions as a retail point of sale, a promotional tool, a market research engine, and a music discovery ecosystem. More than just a record store on wheels, flexibility and adaptability of design and concept set the mobile music store assembly 10 apart from the traditional music retail experience. As described in detail herein, an on-board music player, e.g., turntable, is equipped with one or more individualized listening stations (four are shown in the Figures) that allow consumers to have a full tactile interaction with the product. Additionally, in various embodiments, the music store assembly 10 is entirely wire-free and battery-operated, so that the music store assembly 10 is able to operate virtually anywhere, inside or outdoors. In that sense, the mobile music store assembly 10 is able to bring the digital music consumption model to the physical world by offering to the consumer what the consumer wants, where the consumer wants it, and when the consumer wants it. Further, while most record stores close at night, the music store assembly 10 can remain open and available to music fans at the times they are most likely to buy and interact with physical music product, including concerts, festivals, art openings, artist appearances, and other special events. Additionally, an on-board speaker system further enables the music store assembly 10 to expand into producing personalized events and collaborations with DJs, musicians, and other music business entities, as well as collaborating with existing businesses as a "value add" for their customers (e.g., function as the disk jockey sound system/music retail component for a high end boutique hotel, celebrity gifting, etc.). Moreover, with the recent music industry-wide shift to Friday as a global release date, the music store assembly 10 is positioned to play an integral role in reshaping the music consumption model, especially as vinyl continues to grow in popularity.

As illustrated herein, the music store assembly 10 can be quickly and easily, and selectively moved between a closed configuration (illustrated in FIG. 1A, FIG. 1C and FIG. 1E), which is most convenient for purposes of storage and/or moving the music store assembly 10 between events, and an open configuration (illustrated in FIG. 1B, FIG. 1D and FIG. 1F), which allows users to conveniently play and listen to music anywhere and anytime.

In various embodiments, the music store assembly 10 includes a housing assembly 12, one or more wheels 14 (or other movement enabling devices), one or more storage/display areas 16 for purposes of storing and/or displaying one or more vinyl records 18 (illustrated in FIG. 1E), CDs, cassette tapes, etc. (hereinafter sometimes collectively referred to as "music media"), and a music production and listening assembly 20 (illustrated in phantom, and also referred to herein simply as a "production assembly"). Additionally and/or alternatively, in other embodiments, the music store assembly 10 can include more components or fewer components than what is specifically illustrated in the Figures.

The design of the housing assembly 12 can be varied to suit the specific design requirements of the music store assembly 10. The housing assembly 12 is configured to provide housing and support for the various components that make up the production assembly 20. In the embodiment illustrated in FIG. 1A, the housing assembly 12 includes a movable, first housing member 22, a movable, second housing member 24, a housing base 26, and a guide assembly 28.

In certain embodiments, the first housing member 22 is substantially rectangular box-shaped. Additionally, as shown, an upper portion or upper surface of the first housing member 22 can define one or more storage/display areas 16 (in FIG. 1A, the first housing member 22 defines two storage/display areas 16). Alternatively, the first housing member 22 can have another suitable shape.

Somewhat similarly, in some embodiments, the second housing member 24 is also substantially rectangular box-shaped. Additionally, as shown, an upper portion or upper surface of the second housing member 24 can also define one or more storage/display areas 16 (in FIG. 1A, the second housing member 24 defines two storage/display areas 16). Alternatively, the second housing member 24 can have another suitable shape.

Figure 1B:
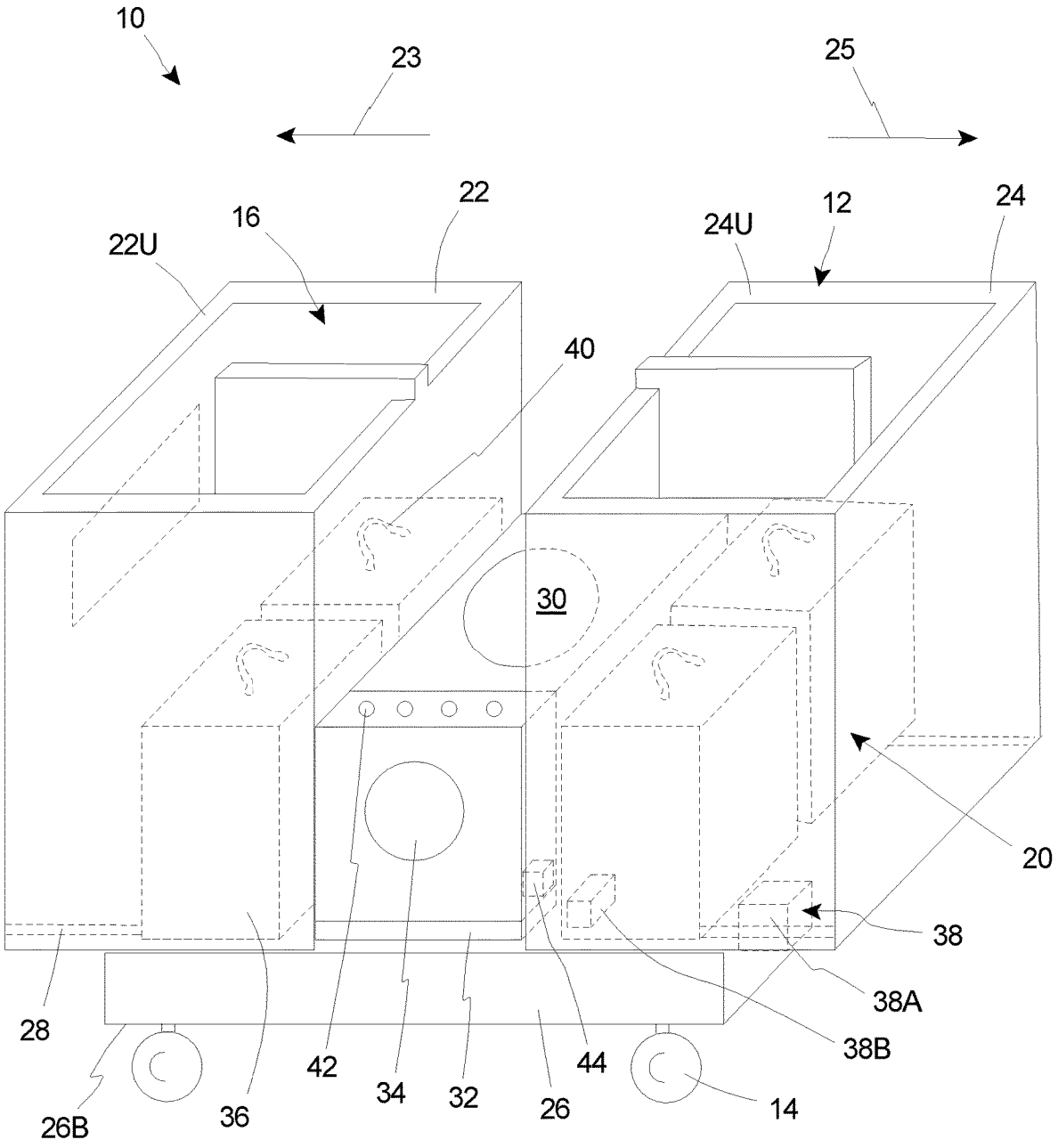
FIG. 1B is another simplified perspective view illustration of the mobile music store assembly illustrated in FIG. 1A, the mobile music store assembly being in an open configuration.

As noted above, in various embodiments, the music store assembly 10 is movable between the closed configuration and the open configuration. As shown, FIG. 1A illustrates the music store assembly 10 in the closed configuration. Referring now to FIG. 1B, FIG. 1B is another simplified perspective view illustration of the music store assembly 10 illustrated in FIG. 1A, with the music store assembly 10 being shown in the open configuration.

In particular, referring to FIGS. 1A and 1B, to enable such movement between configurations, the first housing member 22 is movable relative to the second housing member 24 and/or the housing base 26 between a first position (as shown in FIG. 1A, with the music store assembly 10 being in the closed configuration) and a second position (as shown in FIG. 1B, with the music store assembly 10 being in the open configuration). The movement of the first housing member 22 from the first position to the second position is indicated by arrow 23 (also illustrated in FIG. 1D and FIG. 1F).

To further enable the movement between configurations, the second housing member 24 is movable relative to the first housing member 22 and/or the housing base 26 between a first position (as shown in FIG. 1A, with the music store assembly 10 being in the closed configuration) and a second position (as shown in FIG. 1B, with the music store assembly 10 being in the open configuration). The movement of the second housing member 24 from the first position to the second position is indicated by arrow 25 (also illustrated in FIG. 1D and FIG. 1F).

The housing base 26 supports the first housing member 22, the second housing member 24, and the various components that form the production assembly 20. In some embodiments, as shown, the housing base 26 can be a rigid, rectangular plate that is positioned substantially directly beneath the first housing member 22 and the second housing member 24 when the music store assembly 10 is in the closed configuration. Alternatively, the housing base 26 can have a different design or be positioned in a different manner.

The guide assembly 28 is positioned adjacent to the housing base 26 and guides the movement of the first housing member 22 and the second housing member 24 relative to the housing base 26. The guide assembly 28 can have any suitable design that guides and enables such relative movement between the housing members 22, 24 and the housing base 26. For example, in one non-exclusive alternative embodiment, the guide assembly 28 can be formed as a plurality of tracks (i.e. a track system), with the housing members 22, 24 being configured to move along the tracks relative to the housing base 26. Alternatively, the guide assembly 28 can have another suitable design.

It should be appreciated that the housing members 22, 24 can be moved relative to one another and relative to the housing base 26 in any suitable manner. For example, the housing members 22, 24 can be moved relative to one another and relative to the housing base 26 manually and/or with the use of one or more actuators (not illustrated).

The wheels 14 are coupled to the housing assembly 12 and movably support the housing assembly 12 relative to a support surface 29 (illustrated in FIG. 1C), such as the ground or a floor. More particularly, in the embodiment shown in FIGS. 1A and 1B, the wheels are coupled to a bottom surface 26B of the housing base 26. The design of the wheels 14 and the number of wheels 14 can be varied. In one embodiment, the music store assembly 10 includes four, selectively lockable wheels 14, with one wheel 14 being positioned near each corner of the bottom surface 26B of the housing base 26. Alternatively, the music store assembly 10 can include greater than four or fewer than four wheels 14 and/or the wheels 14 can be positioned in a different manner. Still alternatively, the music store assembly 10 can be designed without any wheels and the music store assembly 10 can be designed and/or configured to move relative to the support surface 29 in another suitable manner.

As noted above, the one or more storage/display areas 16 can be provided for purposes of storing and/or displaying one or more vinyl records 18, CDs, cassette tapes, etc. The design and positioning of the storage/display areas 16 can be varied. In this embodiment, the music store assembly 10 includes four storage/display areas 16 that are formed along an upper surface 22U of the first housing member 22 and an upper surface 24U of the second housing member 24. More specifically, in such embodiment, the music store assembly 10 can include two storage/display areas 16 that are formed along the upper surface 22U of the first housing member 22, and two storage/display areas 16 that are formed along the upper surface 24U of the second housing member 24. Alternatively, the music store assembly 10 can be designed with greater than four or fewer than four storage/display areas 16 and/or the storage/display areas 16 can be positioned in a different manner.

The production assembly 20 enables the user to produce music as well as enabling one or more individuals, or users, to listen to the music, either privately or publicly. The design of the production assembly 20 can be varied. Additionally, it should be appreciated that the number and positioning of the various components that make up the production assembly 20 can be varied from what is specifically shown in the Figures. Further, it should also be appreciated that the production assembly 20 can include more components and/or fewer components than what is specifically illustrated in the Figures. One skilled in the relevant art would appreciate various modifications that could be made to the design of the production assembly 20, while taking into consideration the details of the present disclosure.

In various embodiments, the production assembly 20 can include such components as (i) a music player 30 (illustrated in phantom in FIG. 1A), e.g., a turntable, for purposes of playing the vinyl records 18 or other music sources; (ii) an amplifier 32 (illustrated in phantom in FIG. 1A) that is electrically coupled to the music player 30; (iii) a tweeter 34 (illustrated in phantom in FIG. 1A) that is electrically coupled to the music player 30; (iv) one or more speakers 36 (four are illustrated in phantom in FIG. 1A) that are electrically coupled to the amplifier 42 and/or the music player 30; and (v) a power assembly 38 (illustrated in phantom), including a power source 38A (illustrated in phantom), e.g., one or more batteries, and a power converter 38B (illustrated in phantom), that is electrically coupled to the music player 30, the amplifier 32, the tweeter 34 and the one or more speakers 36 for providing the necessary and desired power to such other components of the production assembly 20.

Additionally, in certain embodiments, to enable a more personalized listening experience, the production assembly 20 can further include one or more headphones 40 (four are shown in phantom in FIG. 1A), one or more headphone connectors 42 (four are shown in phantom in FIG. 1A) for electrically coupling the headphones 40 to the music player 30 and/or the amplifier 32, and a preamp/headphone amp 44 (illustrated in phantom).

Further, as illustrated, the production assembly 20 can also include a control panel 45 (illustrated in phantom) that enables the user to control the various features and components of the production assembly 20. More particularly, the control panel 45 is electrically connected to various features and components that can be incorporated as part of the production assembly 20 to enable the user to control such features and components. In some embodiments, as shown in FIG. 1A, the control panel 45 can be coupled to one of the housing members 22, 24 of the housing assembly 12. Alternatively, the control panel 45 can be coupled to another part of the housing assembly 12. Still alternatively, in other embodiments, the control panel 45 can be provided separately from the housing assembly 12, but can still be electrically connected, e.g., wirelessly electrically connected, to various features and components of the production assembly 20. It is further appreciated that, in some embodiments, there may be a master control panel and/or there may be individual control panels for each listening station.

During use, in certain embodiments, the production assembly 20 and all the components thereof are not accessible to the user when the music store assembly 10 is in the closed configuration. Stated in another manner, in such embodiments, the production assembly 20 and all the components thereof are fully enclosed within the housing assembly 12 when the music store assembly 10 is in the closed configuration. Conversely, in such embodiments, the user is able to access one or more components of the production assembly 20, e.g., the music player 30, the amplifier 32, the speakers 36, the headphones 40 and the headphone connectors 42, when the music store assembly 10 is in the open configuration. However, it is appreciated that in such embodiments, all components of the production assembly 20, i.e. the music player 30, the amplifier 32, the tweeter 34, the speakers 36, the power assembly 38, the headphones 40, the headphone connectors 42, and the preamp/headphone amp 44, are positioned substantially within the housing assembly 12.

The power assembly 38 can have any suitable design. For example, as noted above, the power assembly 38 can include the power source 38A, e.g., one or more batteries or another suitable power source, and a power converter 38B. The power converter 38B can receive power from the power source 38A and convert such power into a format that is nusable for providing power to the production assembly 20 and the various components thereof.

Additionally, as noted above, in various embodiments, the power assembly 38 is configured to provide all of the necessary power for the music store assembly 10 without being connected to any outside electrical or power sources, e.g., by one or more wired connections. Stated in another manner, in such embodiments, the power assembly 38 and/or the power source 38A that provides all the necessary power for the music corn store assembly 10 is fully contained within the housing assembly 12 of the music store assembly 10.

Figure 1C:
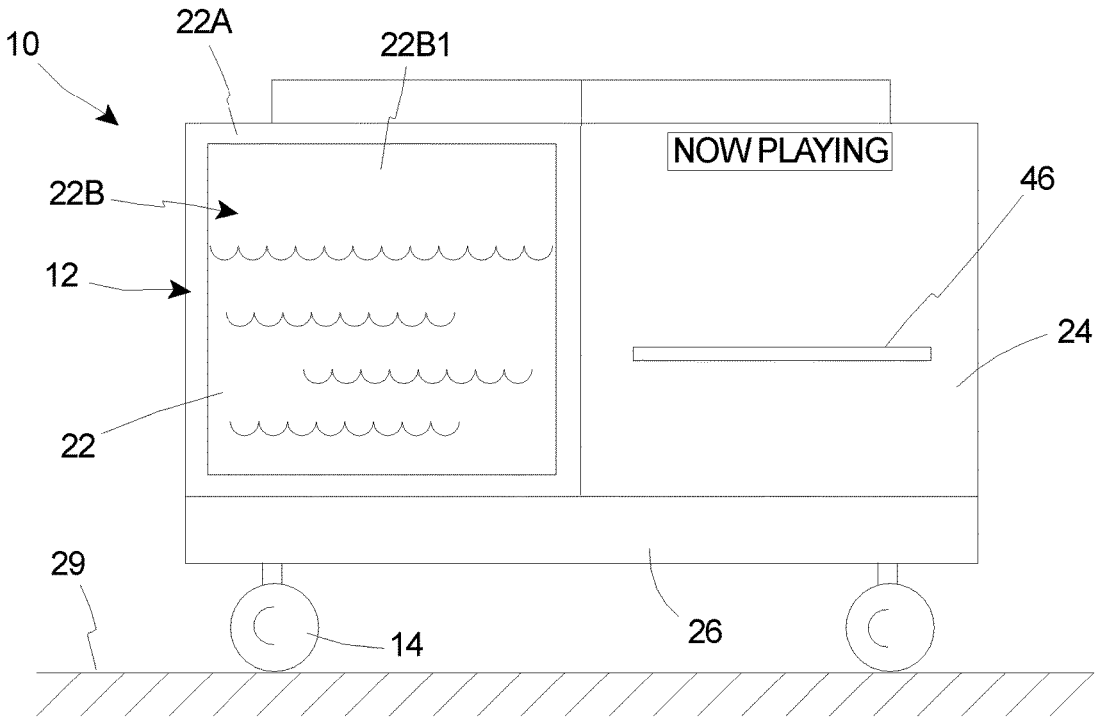
FIG. 1C is a simplified side view illustration of the mobile music store assembly illustrated in FIG. 1A, the mobile music store assembly being in the closed configuration.
Figure 1D:
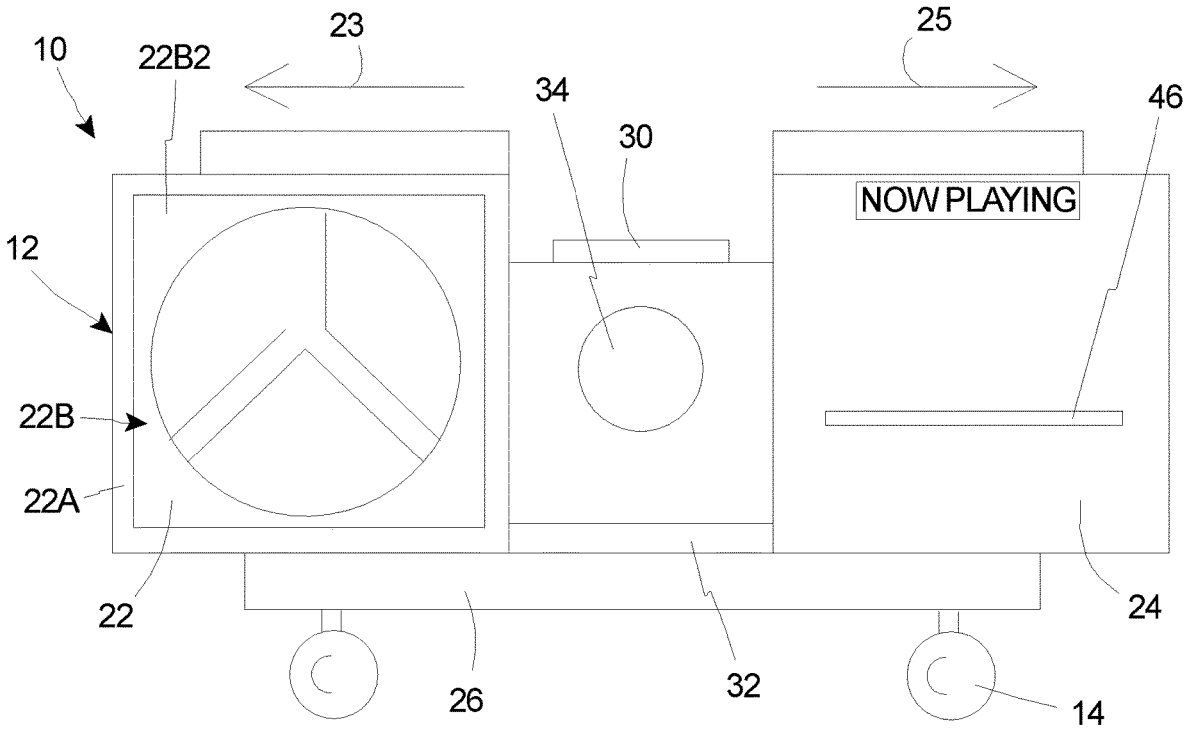
FIG. 1D is another simplified side view illustration of the mobile music store assembly illustrated in FIG. 1A, the mobile music store assembly being in the open configuration.
Figure 1E:
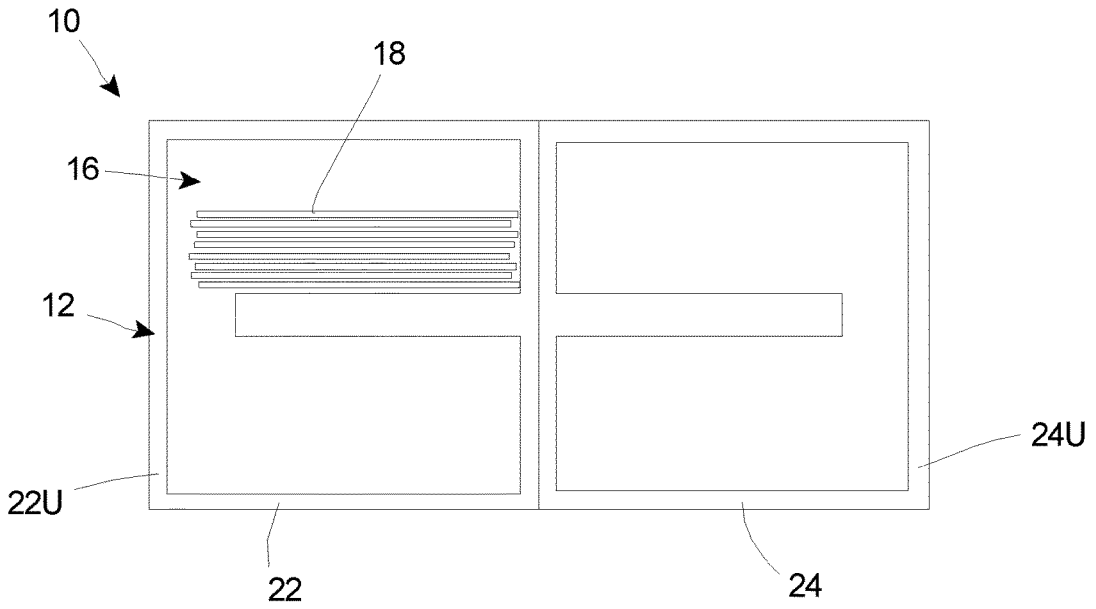
FIG. 1E is a simplified top view illustration of the mobile music store assembly illustrated in FIG. 1A, the mobile music store assembly being in the closed configuration.
Figure 1F:
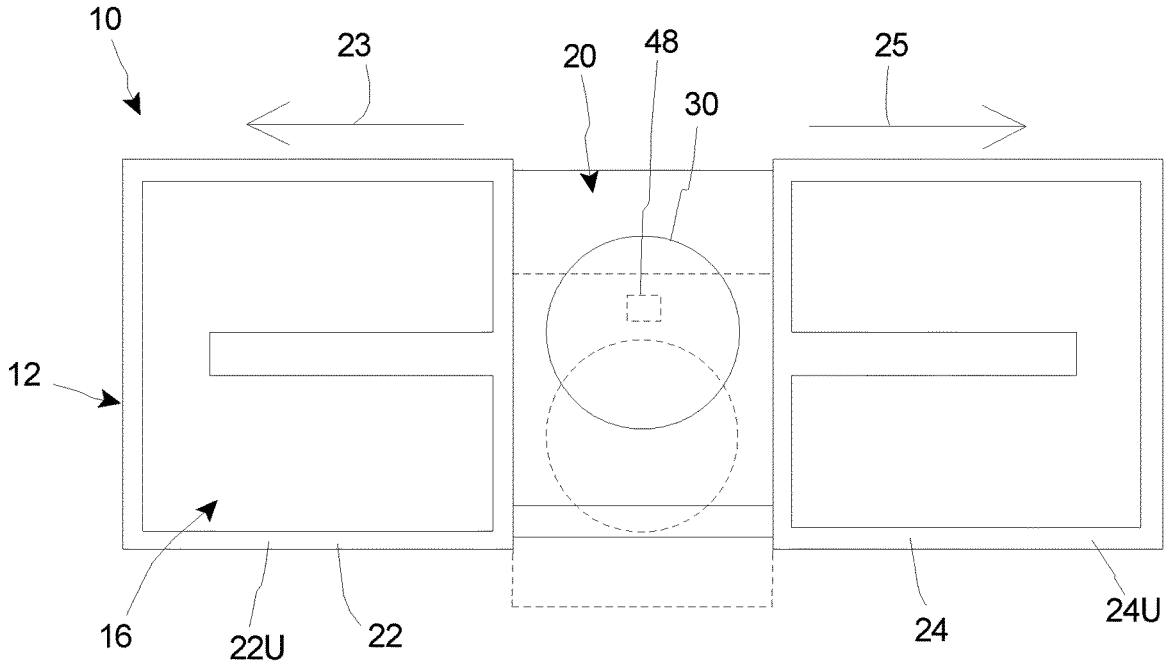
FIG. 1F is another simplified top view illustration of the mobile music store assembly illustrated in FIG. 1A, the mobile music store assembly being in the open configuration.
Figure 1G:
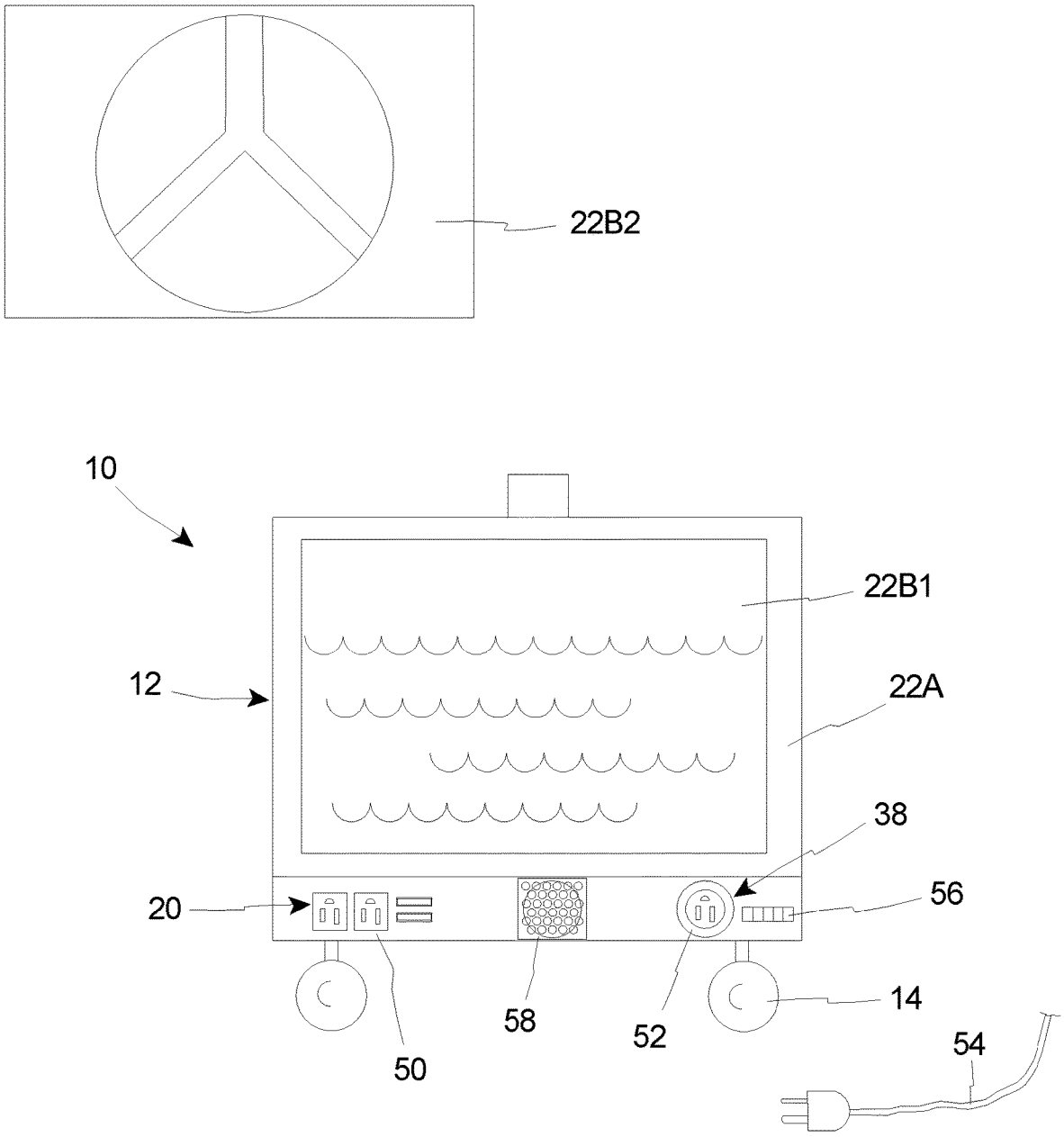
FIG. 1G is a simplified end view illustration of the mobile music store assembly illustrated in FIG. 1A.
Figure 1H:
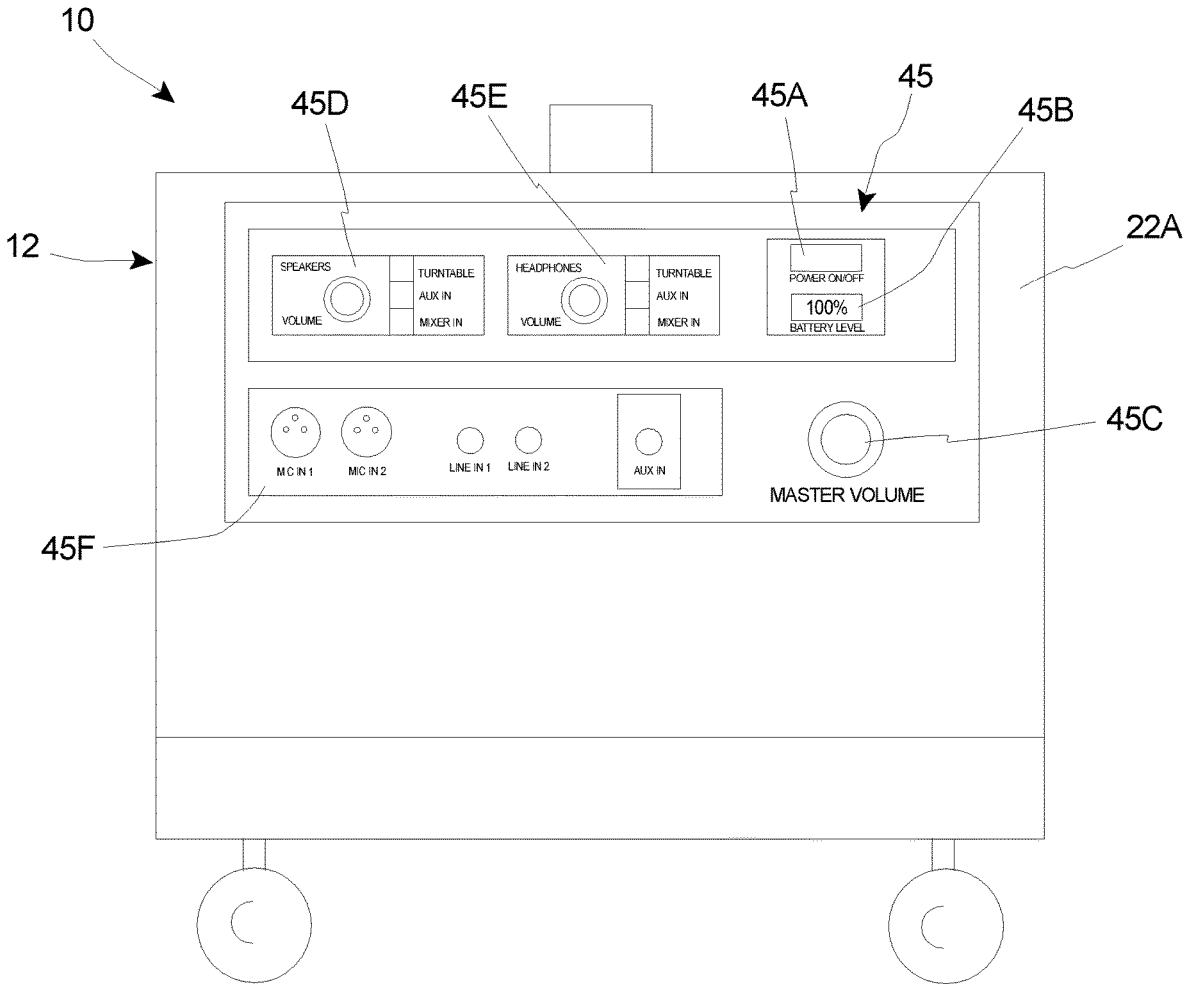
FIG. 1H is another simplified end view illustration of the mobile music store assembly illustrated in FIG. 1A.

FIGS. 1C-1H provide alternative views of the music store assembly 10 and the various components thereof, with certain Figures showing the music store assembly 10 in the closed configuration and other Figures showing the music store assembly in the open configuration. More specifically, FIG. 1C is a simplified side view illustration of the music store assembly 10 illustrated in FIG. 1A, the music store assembly 10 being in the closed configuration; FIG. 1D is another simplified side view illustration of the music store assembly 10 illustrated in FIG. 1A, the music store assembly 10 being in the open configuration; FIG. 1E is a simplified top view illustration of the music store assembly 10 illustrated in FIG. 1A, the music store assembly 10 being in the closed configuration FIG. 1F is another simplified top view illustration of the music store assembly 10 illustrated in FIG. 1A, the music store assembly 10 being in the open configuration; FIG. 1G is a simplified end view illustration of the music store assembly 10 illustrated in FIG. 1A; and FIG. 1H is another simplified end view illustration of the music store assembly 10 illustrated in FIG. 1A. Additionally, certain additional features that may be included in some embodiments of the music store assembly 10 are more clearly illustrated and described in relation to one or more of FIGS. 1C-1H.

As shown, FIG. 1C illustrates an alternative view of the housing assembly 12 including the first housing member 22, the second housing member 24 and the housing base 26, and the wheels 14 that are configured to move along the support surface 29. Additionally, FIG. 1D illustrates another alternative view of the housing assembly 12 including the first housing member 22, the second housing member 24 and the housing base 26, the wheels 14, and the music player 30, the amplifier 32 and the tweeter 34 of the production assembly 20.

Further, in some embodiments, as shown in FIGS. 1C and 1D, at least one of the first housing member 22 and the second housing member 24 of the housing assembly 12 can include a housing body 22A, and a plurality of body panels 22B that are alternatively, removably coupled to the housing body 22A. More particularly, as shown in FIG. 1C, the first housing member 22 includes the housing body 22A and a first body panel 22B1 that has been selectively and removably coupled to the housing body 22A. Further, as shown in FIG. 1D, an alternative, second body panel 22B2 has now been selectively and removably coupled to the housing body 22A of the first housing member 22.

It is appreciated that the alternative body panels 22B can be selectively and removably coupled to any area of the housing body 22A. For example, in certain such embodiments, the housing member 22, 24 can including removable side panels (such as shown in FIGS. 1C and 1D) and/or removable end panels (such as shown in FIG. 1G). With the inclusion of the removable body panels 22B, the look and feel of the music store assembly 10 can be quickly and easily changed by merely swapping out the body panels 22B. It is further appreciated that the potential designs that could be included on the removable body panels 22B are effectively limitless, and merely depend on the imagination of the user.

Additionally, as also shown in FIGS. 1C and 1D, in certain embodiments, the music store assembly 10 can further include a display rack 46 that is provided on an outer surface of the housing assembly 12, e.g., on an outer surface of the first housing member 22 and/or the second housing member 24. For example, in one such embodiment, the display rack 46 can be provided in the form of a small metal strip on the outer surface of the second housing member 24 that is configured to hold a record for display purposes. More particularly, in some applications, the display rack 46 can be used to display the record that is currently playing on the music player 30.

FIG. 1E illustrates still another alternative view of the housing assembly 12 including the first housing member 22, the second housing member 24, and the storage/display areas 16 that can be formed along the upper surface 22U, 24U of the first housing member 22 and the second housing member 24, respectively. Additionally, as noted, FIG. 1E also illustrates a plurality of records 18 that can be stored and/or displayed within the storage/display areas 16.

Additionally, FIG. 1F illustrates yet another alternative view of the housing assembly 12 including the first housing member 22, the second housing member 24 and the storage/display areas 16, and the music player 30 of the production assembly 20.

Further, in certain embodiments, as shown in FIG. 1F, the music player 30 can be selectively movable between a retracted (base) configuration (shown in solid lines) and an extended configuration (shown in dashed lines). As illustrated, it is appreciated that when the music store assembly 10 is in the closed configuration, the music player 30 is necessarily in the retracted configuration so that the music player 30 can be enclosed within the housing assembly 12. Additionally, In such embodiments, when the music store assembly 10 is in the open configuration, the music player 30 can be selectively moved to the extended configuration so that the music player 30 is more accessible for the user of the music store assembly 10. More particularly, in such embodiments, the music store assembly 10 and/or the production assembly 20 can further include a player mover assembly 48 (illustrated as a box in phantom, and also sometimes referred to herein simply as a "mover assembly") that is coupled to the music player 30 in order to move the music player 30 between the retracted configuration and the extended configuration. The mover assembly 48 can have any suitable design. For example, in one non-exclusive alternative embodiment, the mover assembly 48 can include a telescoping arm that is used to selectively move the music player 30, e.g., slide the music player 30 in and out, between the retracted configuration and the extended configuration. Alternatively, the mover assembly 48 can have another suitable design.

FIG. 1G illustrates still yet another alternative view of the housing assembly 12 including a removable first body panel 22B1 that is selectively coupled to the housing body 22A and a second body panel 22B2 that can be alternatively, removably coupled to the housing body 22A, and the wheels 14 of the music store assembly 10. It is appreciated that, as stated above, the housing body 22A to which the body panels 22B1, 22B2 are alternatively, removably coupled can be part of the first housing member 22 and/or the second housing member 24.

Additionally, FIG. 1G illustrates certain features and components that can be included in some embodiments of the power assembly 38 of the production assembly 20. For example, as shown, the power assembly 38 can include one or more electrical connection sites 50, e.g., standard electrical outlets, USB ports, etc., that enable the user to plug additional electronic devices into the music store assembly 10 to use the power from the power assembly 38.

Further, in some embodiments, the power assembly 38 can also include a recharging port 52 and a recharging cable 54. In such embodiments, the recharging cable 54 can be selectively, electrically coupled to the recharging port 52 and an external power source (not shown) to selectively recharge the power source 38A (illustrated in FIG. 1A). For example, in embodiments where the power source 38A includes one or more batteries, the recharging cable 54 can be selectively, electrically coupled to the recharging port 52 and the external power source to selectively recharge the one or more batteries. Additionally, as shown, in certain such embodiments, the power assembly 38 can also include a source power meter 56 that displays the power level status of the power source 38A at any given time. More specifically, in such embodiments, the source power meter 56 can show charge life and hours left to run for the power source 38A before the power source 38A needs to be plugged in for purposes of recharging the power source 38A. With such design, the user is better able to ensure that the music store assembly 10 and/or the production assembly 20 always has a sufficient amount of power.

FIG. 1G also shows that the music store assembly 10 can also include a vent 58 for removing heat that is generated within the housing assembly 12 due to use of the production assembly 20.

FIG. 1H is another simplified end view illustration of the music store assembly 10 illustrated in FIG. 1A. In particular, FIG. 1H illustrates another alternative view of the housing assembly 12 and an embodiment of the control panel 45 that is electrically coupled to various components of the production assembly 20. As shown, in some embodiments, the control panel 45 can be coupled to the housing body 22A of the housing assembly 12. Additionally, or in the alternative, as noted above, it is appreciated that the control panel 45 can be coupled to any suitable portion of the housing assembly 12 and/or the control panel 45 can be provided separately and be electrically coupled (e.g., wirelessly) to various components of the production assembly 20. Moreover, in certain embodiments, the music store assembly 10 and/or the production assembly 20 can include more than one control panel 45, e.g., a separate control panel for each individual listening station.

As illustrated, the control panel 45 can include various buttons, knobs, electrical connection sites and/or display features that enable better and easier control of the production assembly 20 for the user. In certain embodiments, as illustrated in FIG. 1H, the control panel 45 can include a power on/off control 45A, a battery level display 45B, a master volume control 45C, a speakers control section 45D, a headphones control section 45E, and an external component connection section 45F. Alternatively, the control panel 45 can include more or fewer buttons, knobs, connectors and/or display features than what is specifically illustrated and described herein. For example, in one non-exclusive alternative embodiment, the control panel 45 can further include electrical connections for line out (not shown), where sound from the production assembly 20 can be piped to an auxiliary sound system (not shown).

The power on/off control 45A enables the user to selectively turn on and off the music store assembly 10, i.e. the production assembly 20. Additionally, similar to the source power meter 56 (illustrated in FIG. 1G), the battery level display 45B illustrates the level of charge that is left in the power source 38A (illustrated in FIG. 1G), e.g., the batteries.

The master volume control 45C allows the user to control the volume of various components within the production assembly 20 and/or external components that are electrically coupled to the production assembly 20. In some embodiments, the master volume control 45C is only usable to control the volume coming out of the speakers 36 (illustrated in FIG. 1A), and not the headphones 40 (illustrated in FIG. 1A), from the music player 30 (illustrated in FIG. 1A) and/or from any external components. Alternatively, in other embodiments, the master volume control 45C can be used to control the volume coming out of both the speakers 36 and the headphones 40.

The speakers control section 45D provides the user with the opportunity to individually control the functioning of the speakers 36. As shown, the speakers control section 45D can include a volume control specifically for the speakers 36, as well as a means for selecting the source of sound that is being played through the speakers 36, i.e. from the music player 30, e.g., turntable, an auxiliary external component that may be connected to the production assembly 20, and/or from a sound mixer that may be connected to the production assembly 20.

Similarly, the headphones control section 45E provides the user with the opportunity to individually control the functioning of the headphones 40. As shown, the headphones control section 45E can include a volume control specifically for the headphones 40, as well as a means for selecting the source of sound that is being played through the headphones 40, i.e. from the music player 30, e.g., turntable, an auxiliary external component that may be connected to the production assembly 20, and/or from a sound mixer that may be connected to the production assembly 20.

It is appreciated that the speakers control section 45D and the headphones control section 45E can function individually or in combination essentially as a line selector, which enables the user to choose whether sound is being played externally from the speakers 36, through the headphones 40, or both.

The external component connection section 45F provides a means to enable a user to connect various external components to the production assembly 20. For example, inputs from external sources are enabled for if the user wanted to plug in a DJ or a small band, with the production assembly 20 to be used for amplification; and/or if the user wanted to run a digital mix off a phone or other component to be played through the speakers 36 of the production assembly 20. Additionally, the external component connection section 45F can be utilized for connecting any other suitable external components for use through the production assembly 20.

It is understood that although a number of different embodiments of the mobile music store assembly 10 have been illustrated and described herein, one or more features of any one embodiment can be combined with one or more features of one or more of the other embodiments, provided that such combination satisfies the intent of the present invention.

While a number of exemplary aspects and embodiments of the mobile music store assembly 10 have been shown and disclosed herein above, those of skill in the art will recognize certain modifications, permutations, additions and sub-combinations thereof. It is therefore intended that the system and method shall be interpreted to include all such modifications, permutations, additions and sub-combinations as are within their true spirit and scope, and no limitations are intended to the details of construction or design herein shown.

What is claimed is:

1. A mobile music store assembly, comprising:

a housing assembly including (i) a housing base; and (ii) a first housing member and a second housing member that are each selectively movable relative to the housing base such that the mobile music store assembly can be alternatively positioned in a closed configuration and an open configuration;

a power source that is integrated within the housing assembly;

a music player that is positioned substantially within the housing assembly; and a mover assembly that is configured to move the music player between a retracted position and an extended position when the mobile music store assembly is in the open configuration; and wherein the music player is configured to play music in both the retracted position and the extended position utilizing power directly from the power source.

2. The mobile music store assembly of claim 1 wherein the housing assembly further includes a guide assembly that guides the linear movement of at least one of the first housing member and the second housing member relative to the housing base.

3. The mobile music store assembly of claim 1 further comprising a speaker that is electrically coupled to the music player, the speaker being positioned substantially within the housing assembly.

4. The mobile music store assembly of claim 1 further comprising headphones that are electrically coupled to the music player, the headphones being positioned substantially within the housing assembly.

5. The mobile music store assembly of claim 1 wherein the power source is fully contained within the housing assembly.

6. The mobile music store assembly of claim 1 wherein the power source is part of a power assembly that includes a recharging port and a recharging cable that is selectively electrically coupled to the recharging port to recharge the power source.

7. The mobile music store assembly of claim 1 further comprising at least three wheels that are coupled to the housing assembly.

8. The mobile music store assembly of claim 1 wherein the first housing member and the second housing member slidingly move relative to one another.

9. The mobile music store assembly of claim 1 further comprising a plurality of storage/display areas that store music media.

10. A mobile music store assembly, comprising:

a housing assembly including (i) a housing base; (ii) a first housing member that is linearly movable relative to the housing base between a first position and a second position; and (iii) a second housing member that is linearly movable relative to the first housing member and the housing base between a first position and a second position, wherein when the first and second housing members are in the first position, the first and second housing members are adjacent to one another and the mobile music store assembly is in the closed configuration, and when the first and second housing members are in the second position, the first and second housing members are directly away from one another and the mobile music store assembly is in the open configuration;

a music player that is supported by the housing base, the music player being substantially surrounded by the housing assembly when the mobile music store assembly is in the closed configuration, and wherein the music player is only exposed and accessible to a user while the mobile music store assembly is in the open configuration; and a plurality of storage/display areas that store music media.

11. The mobile music store assembly of claim 10 wherein the housing assembly further includes a guide assembly that guides the linear movement of at least one of the first housing member and the second housing member relative to the housing base.

12. The mobile music store assembly of claim 10 further comprising a speaker that is electrically coupled to the music player, the speaker being positioned substantially within the housing assembly.

13. The mobile music store assembly of claim 10 further comprising headphones that are electrically coupled to the music player, the headphones being positioned substantially within the housing assembly.

14. The mobile music store assembly of claim 10 further comprising a power assembly that provides power to the music player, the power assembly including a power source that is fully contained within the housing assembly.

15. The mobile music store assembly of claim 14 wherein the power assembly further includes a recharging port and a recharging cable that is selectively electrically coupled to the recharging port to recharge the power source.

16. The mobile music store assembly of claim 10 further comprising at least three wheels that are coupled to the housing assembly.

17. The mobile music store assembly of claim 10 wherein the first housing member and the second housing member slidingly move relative to one another.

18. The mobile music store assembly of claim 10 further comprising a mover assembly that is coupled to the music player, the mover assembly being configured to move the music player between a retracted position and an extended position when the mobile music store assembly is in the open configuration.

19. A mobile music store assembly, comprising:

a housing assembly including (i) a housing base; (ii) a first housing member that is linearly movable relative to the housing base between a first position and a second position; and (iii) a second housing member that is linearly movable relative to the first housing member and the housing base between a first position and a second position, wherein when the first and second housing members are in the first position, the first and second housing members are adjacent to one another and the mobile music store assembly is in the closed configuration, and when the first and second housing members are in the second position, the first and second housing members are directly away from one another and the mobile music store assembly is in the open configuration;

a music player that is supported by the housing base, the music player being substantially surrounded by the housing assembly when the mobile music store assembly is in the closed configuration, and wherein the music player is only exposed and accessible to a user while the mobile music store assembly is in the open configuration; and a speaker that is electrically coupled to the music player, the speaker being positioned substantially within the housing assembly.

20. A mobile music store assembly, comprising:

a housing assembly including (i) a housing base; (ii) a first housing member that is linearly movable relative to the housing base between a first position and a second position; and (iii) a second housing member that is linearly movable relative to the first housing member and the housing base between a first position and a second position, wherein when the first and second housing members are in the first position, the first and second housing members are adjacent to one another and the mobile music store assembly is in the closed configuration, and when the first and second housing members are in the second position, the first and second housing members are directly away from one another and the mobile music store assembly is in the open configuration;

a music player that is supported by the housing base, the music player being substantially surrounded by the housing assembly when the mobile music store assembly is in the closed configuration, and wherein the music player is only exposed and accessible to a user while the mobile music store assembly is in the open configuration; and headphones that are electrically coupled to the music player, the headphones being positioned substantially within the housing assembly.

* * * * *